US012364367B2

(12) United States Patent
Zhang et al.

(10) Patent No.: US 12,364,367 B2
(45) Date of Patent: Jul. 22, 2025

(54) BATHTUB BATH BOARD AND BATHTUB

(71) Applicant: Kohler (China) Investment Co., Ltd., Shanghai (CN)

(72) Inventors: Hua Zhang, Shanghai (CN); Jiqin Zhang, Shanghai (CN); Jianqing Zhang, Shanghai (CN)

(73) Assignee: Kohler (China) Investment Co., Ltd., Shanghai (CN)

( * ) Notice: Subject to any disclaimer, the term of this patent is extended or adjusted under 35 U.S.C. 154(b) by 174 days.

(21) Appl. No.: 18/088,208

(22) Filed: Dec. 23, 2022

(65) Prior Publication Data

US 2023/0200593 A1 Jun. 29, 2023

(30) Foreign Application Priority Data

Dec. 27, 2021 (CN) ..... 202123317228.8

(51) Int. Cl.
*A47K 3/12* (2006.01)

(52) U.S. Cl.
CPC ..... *A47K 3/12* (2013.01)

(58) Field of Classification Search
CPC ..... A47K 3/12; A47K 3/122; A47K 3/125; A47K 3/127; A47K 3/14; A47K 3/282; E03C 1/186
See application file for complete search history.

(56) References Cited

U.S. PATENT DOCUMENTS 128,755 A * 7/1872 Robb ..... A47K 3/122 4/590
170,762 A * 12/1875 Nye ..... A47K 3/122 4/579
612,823 A * 10/1898 Conway ..... E03C 1/186 4/514
1,740,444 A * 12/1929 Downham ..... A47K 3/122 4/579
2,236,927 A * 4/1941 Thomas ..... A47K 3/122 4/579
2,671,908 A * 3/1954 Tronic ..... A47K 3/122 4/579
2009/0049596 A1* 2/2009 Ferris ..... E03C 1/186 4/514

FOREIGN PATENT DOCUMENTS

GB 2457985 A * 9/2009 ..... A47K 3/122

* cited by examiner

*Primary Examiner* — Erin Deery
(74) *Attorney, Agent, or Firm* — FOLEY & LARDNER LLP

(57) ABSTRACT

A bathtub system includes a bathtub body and a bath plate. The bath tub body defines a bathing volume. The bath plate is configured to detachably connect with the bathtub body within the bathing volume. The bath plate includes a bath plate body and telescopic pieces arranged on two sides of the bath plate body. The telescopic pieces are fixedly connected with the bath plate body. A wall of the bathtub body includes a wall protrusion configured to retain the telescopic piece.

18 Claims, 5 Drawing Sheets

BATHTUB BATH BOARD AND BATHTUB

CROSS REFERENCE TO RELATED PATENT APPLICATION

This application claims the benefit of and priority to Chinese Patent Application No. 202123317228.8, filed on Dec. 27, 2021, the disclosure of which is incorporated herein by reference in its entirety.

TECHNICAL FIELD

The present disclosure relates to the technical field of sanitary products. More specifically, to bathtubs and bath boards.

BACKGROUND

A bathing environment may include a bathtub, shower basin, or hybrids thereof. Bathtubs and shower basins are configured to capture and direct fluids dispensed into a bathing space of a bathing environment. A bathtub has a bottom and side walls that define a bathing volume configured to receive at least a portion of a user, and may have a closable drain. A shower basin may include a bottom, a drain, and a raised perimeter wall. A bathtub may facilitate accumulating fluid (e.g., filling the bathing volume of the bathtub), or not accumulating fluid (e.g., directing fluid to an open drain), within the bathing volume when fluid (e.g., water) is dispensed into the bathing volume (e.g., from a shower head, from a bathtub faucet, from a shower head and a bathtub faucet, etc.). A shower basin is shaped and sized to facilitate a user standing, sitting, and/or shifting within the bathing space. A bathtub is often shaped and sized to facilitate a user laying, sitting, and standing on the bottom. Bathtubs often have a larger foot print than shower basins (e.g., because they are configured to accommodate a user laying within the shower space).

Bathtub walls may cause a user to step over the walls in order for the user to enter or exit the shower volume. Stepping over walls in a bathing environment is burdensome and can provide opportunities for a user to slip or lose their balance, especially for users having limited mobility.

A walk-in bathtub allows a user to selectively open a door in the wall of the bathtub to locally reduce the height of the wall which can facilitate a user entering the bathing volume without traversing a full-height wall of the bathtub. Once inside the walk-in bathtub, a user may selectively close the door to close the void in the wall of the bathtub. A user may endeavor to shower (e.g., bathe within water flowing from a shower head) and/or bathe (e.g., take a bath, bathe within water accumulated within the bathing volume, etc.) within the bathing volume.

A walk-in bathtub may have a foot print similar to the foot print of a shower basin, and may facilitate a user standing or sitting within the bathing volume. A walk-in bathtub may have a taller bathing volume (e.g., a deeper bathing volume, taller walls) that can receive a majority of a user seated within the bathing volume. A walk-in bathtub may include shelf or seat that protrudes into the bathing volume and is configured to support a user sitting on the shelf or seat.

SUMMARY

At least one embodiment relates to a bath plate for a bathtub. The bath plate includes a bath plate body and multiple telescopic pieces arranged on two sides of the bath plate body. The telescopic pieces are fixedly connected with the bath plate body.

Another embodiment relates to a bathtub system including a bathtub body and a bath plate. The bath tub body defines a bathing volume. The bath plate is configured to detachably connect with the bathtub body within the bathing volume. The bath plate includes a bath plate body and telescopic pieces arranged on two sides of the bath plate body. The telescopic pieces are fixedly connected with the bath plate body. A wall of the bathtub body includes a wall protrusion configured to retain the telescopic piece.

Another embodiment relates to a bathtub system including a bathtub body and a bath plate. The bathtub body has walls and a bottom defining a bathing volume. A first wall includes a first wall protrusion and a first step portion. A second wall includes a second wall portion and a second step portion. The first step portion and the second step portion are spaced within the bathing volume. The bath plate is configured to detachably connect with the bathtub body within the bathing volume. The bath plate includes a bath plate body and a bath plate stopper. The bath plate body defines a first cavity on a first side and a second cavity on a second side. The bath plate stopper is configured to slide within the first cavity between a first position and a second position. The bath plate stopper is configured to slide between the first position and the second position to maintain contact with the first wall when the bath plate is in an installed position within the bathing volume.

In some embodiments, a bathtub hip bath plate includes a hip bath plate body where the telescopic pieces are arranged on two sides of the hip bath plate body and the telescopic pieces are fixedly connected with the hip bath plate body.

In some embodiments, the two sides of the hip bath plate body are provided with accommodating cavities, where the accommodating cavity is provided with an opening towards an outside of the hip bath plate body, and the telescopic piece is partially accommodated in the accommodating cavity and protrudes from the opening.

In some embodiments, the telescopic piece comprises a hip bath plate stopper and a resetting piece, the resetting piece is accommodated inside the accommodating cavity, the hip bath plate stopper is partially accommodated inside the accommodating cavity, the hip bath plate stopper partially protrudes from the opening of the accommodating cavity, and the resetting piece is connected with the hip bath plate stopper and exerts a pre-tensioning force towards the opening on the hip bath plate stopper.

In some embodiments, the hip bath plate stopper comprises a stopper head connected with the resetting piece and a stopper body partially protruding from the opening, a diameter of the stopper head is larger than an opening diameter of the accommodating cavity, and a diameter of the stopper body is smaller than the opening diameter of the accommodating cavity.

In some embodiments, the hip bath plate stopper is a plastic stopper.

In some embodiments, the resetting piece is a spring, one end of the spring abuts against a cavity wall of the accommodating cavity, and the other end of the spring abuts against the hip bath plate stopper.

In some embodiments, a bathtub includes a bathtub hip bath plate and a bathtub body detachably connected with the bathtub hip bath plate where a bathtub wall of the bathtub body is provided with a bathtub wall protrusion matched with the telescopic piece.

In some embodiments, a bottom portion of the bathtub body is provided with a step, and the bathtub hip bath plate can be placed on the step.

In some embodiments, a distance between the bathtub wall protrusion and the step is a first distance, when the bathtub hip bath plate is placed on the step, a distance between the telescopic piece and the step is a second distance, and the first distance is larger than the second distance.

In some embodiments, the bathtub wall protrusion is a spacer.

According to the application, by arranging the telescopic pieces on the two sides of the hip bath plate, and through the matching between the telescopic pieces and the bathtub wall protrusions of the bathtub body, the hip bath plate is clamped tightly, and the floating problem of the hip bath plate is solved

BRIEF DESCRIPTION OF THE FIGURES

The disclosure will become more fully understood from the following detailed description, taken in conjunction with the accompanying figures, wherein like reference numerals refer to like elements, in which.

DETAILED DESCRIPTION

Figure 1:
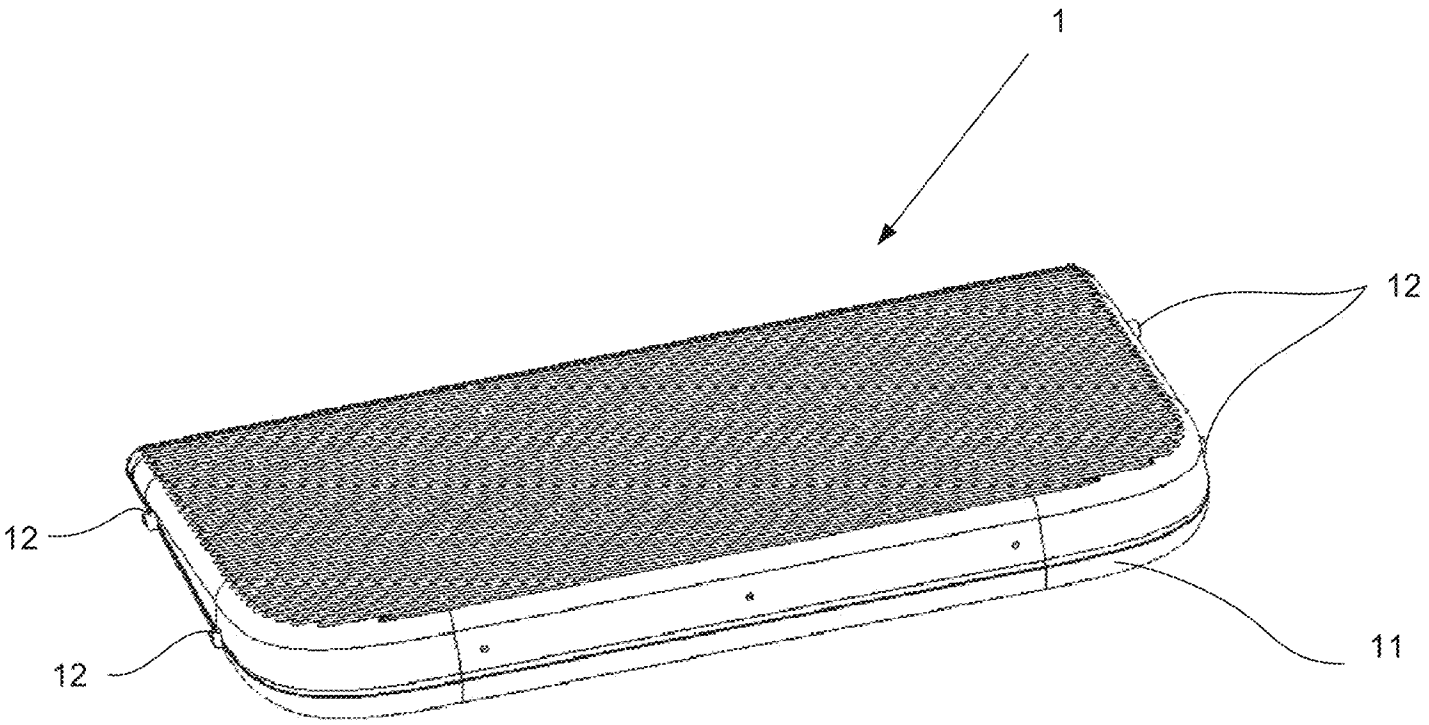
FIG. 1 is a schematic diagram of a bath plate, according to some embodiments.

Before turning to the figures, which illustrate certain exemplary embodiments in detail, it should be understood that the present disclosure is not limited to the details or methodology set forth in the description or illustrated in the figures. It should also be understood that the terminology used herein is for the purpose of description only and should not be regarded as limiting. The various concepts introduced above and discussed in greater detail below may be implemented in any number of ways, as the described concepts are not limited to any particular manner of implementation. Examples of specific implementations and applications are provided primarily for illustrative purposes.

A bathing environment can include a bathtub, shower basin, or hybrids thereof. Bathtubs and shower basins are configured to capture and direct fluids dispensed into a bathing space of a bathing environment. A bathtub has a bottom and side walls that define a bathing volume configured to receive at least a portion of a user, and may have a closable drain. A shower basin may include a bottom, a drain, and a raised perimeter wall. A bathtub may facilitate accumulating fluid (e.g., filling the bathing volume of the bathtub), or not accumulating fluid (e.g., directing fluid to an open drain), within the bathing volume when fluid (e.g., water) is dispensed into the bathing volume (e.g., from a shower head, from a bathtub faucet, from a shower head and a bathtub faucet, etc.). A shower basin is shaped and sized to facilitate a user standing, sitting, and/or shifting within the bathing space. A bathtub is often shaped and sized to facilitate a user laying, sitting, and standing on the bottom. Bathtubs often have a larger foot print than shower basins (e.g., because they are configured to accommodate a user laying within the shower space). Typical bathtubs have fixed walls that cause a user to step over the walls in order for the user to enter or exit the shower volume. Stepping over walls in a bathing environment is burdensome and can provide opportunities for a user to slip or lose their balance, especially for users having limited mobility.

A walk-in bathtub allows a user to selectively open a door in the wall of the bathtub to locally reduce the height of the wall which can facilitate a user entering the bathing volume without traversing a full-height wall of the bathtub. Once inside the walk-in bathtub, a user may selectively close the door to close the void in the wall of the bathtub. A user may endeavor to shower (e.g., bathe within water flowing from a shower head) and/or bathe (e.g., take a bath, bathe within water accumulated within the bathing volume, etc.) within the bathing volume.

A walk-in bathtub may facilitate a user standing or sitting within the bathing volume. A walk-in bathtub may define a tall bathing volume (e.g., a deep bathing volume) that can receive a majority of a user seated within the bathing volume. A walk-in bathtub may include a shelf or seat that protrudes into the bathing volume and is configured to support a user sitting on the shelf or seat.

A typical walk-in bathtub includes a hip bath plate that is permanently fixed within the bathtub. For example, a hip bath plate may be integrally formed with a wall of the bathtub. If a user wants to stand in the bathtub (e.g., stand within the bathing volume) but the bathtub is cramped (e.g., not spacious, not large, etc.), the user's shower experience is affected.

If a hip bath plate is separated from the bathtub, for example, due to deformation (e.g., bowing) of the walls of, for example, a gel coat/acrylic bathtub, being filled with water, the hip bath plate may become loose within the bathing volume. Typical bath plates are easy to float (e.g., buoyant), which can cause the bath plate to quickly travel toward the surface of fluid accumulated within the bathing volume.

The application aims to provide a bath plate and a bathtub that address technical problems, such as the bath plate becoming loose within the bathing volume or floating when the bath plate is not integrally formed with the bathtub or is separated from the bathtub.

The specific embodiments of the application will be further described with reference to the drawings hereinafter. Same parts are denoted by same reference numerals. It should be noted that the terms "front", "back", "left", "right", "up" and "down" used in the following description refer to the directions in the drawings, and the terms "inner" and "outer" refer to the directions towards or far away from geometric centers of specific parts respectively.

Referring generally to the figures, described herein are systems and methods for a bathtub system including a bath plate and bathtub enabling an efficient and reliable operation of a bathing environment. In some embodiments, the bath plate includes a bath plate body and one or more telescopic pieces. The telescoping pieces are arranged on two sides of the bath plate body, and the telescopic pieces are fixedly connected with the hip bath plate body. By arranging the telescopic pieces on the two sides of the bath plate, and through the matching between the telescopic pieces and bathtub wall protrusions of a bathtub body, the hip bath plate is clamped tightly, and is thereby prevented from becoming loose or floating within the bathing volume. The bathing plate and bathtub described herein facilitate improved convenience for the user to install and assemble the bath plate and improves the ergonomics of the bathing environment among other advantages discussed herein.

As shown in FIG. 1, a bath plate (e.g., a bath board, a bathtub hip bath plate, a bathtub seat, a bathtub shelf, etc.) shown as bath plate 1, includes a bath plate body 11. The bath plate body 11 may be seat shaped or shelf shaped, and may be sized to fit snugly between at least one pair of opposing walls of the bathtub. For example, the bath plate body 11 may be configured to span a gap defined between a pair of opposing walls of the bathtub. The bath plate 1 may include one or more telescopic assemblies (e.g., retractable retainer assembly, spring-loaded retainer, etc.), shown as telescopic pieces 12. The telescopic pieces 12 may be arranged on two sides of the bath plate body 11. The telescopic pieces 12 may be fixedly connected with and/or built into the bath plate body 11. For example, the telescopic pieces 12 may be retained by the bath plate body 11.

In some embodiments, the telescopic piece 12 can be retracted towards an interior of the bath plate body 11 when subjected to an external force, or extended out of the bath plate body 11 when the external force is released. For example, the telescopic piece 12 may be biased toward a protruding position by a biasing member such as a spring, a magnet, etc.

Figure 2:
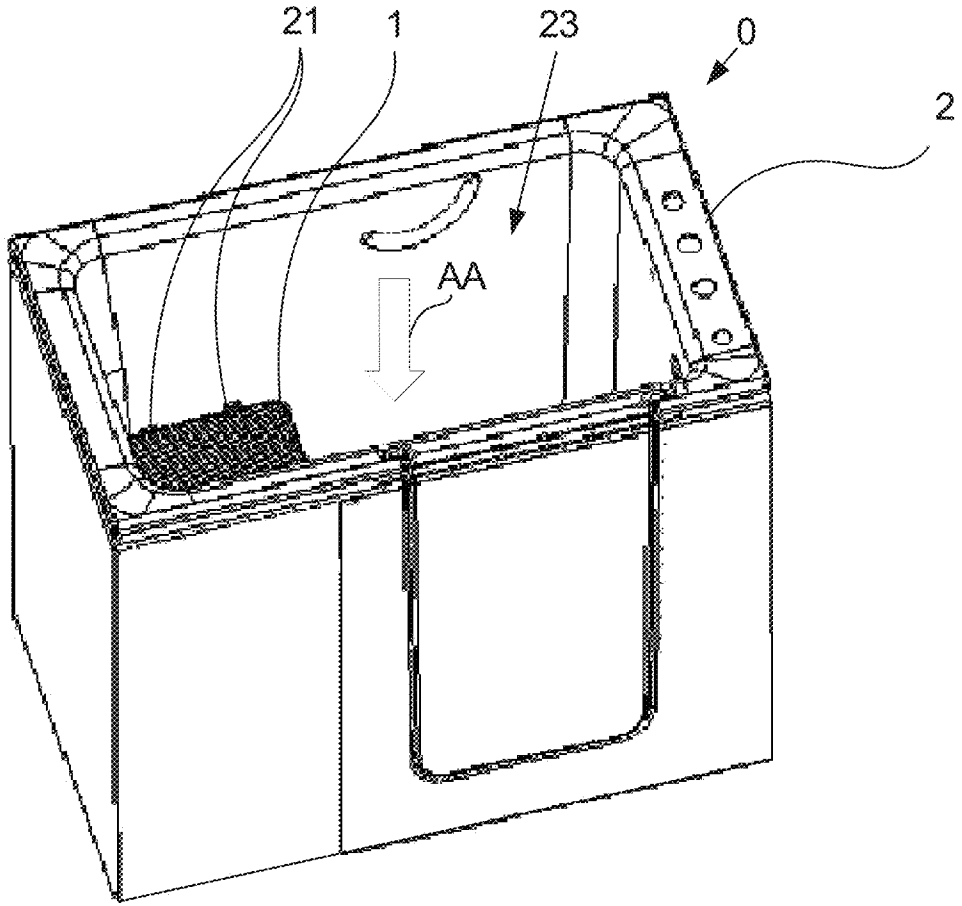
FIG. 2 is a schematic diagram of a bathtub and the bath plate of FIG. 1, according to some embodiments.
Figure 3:
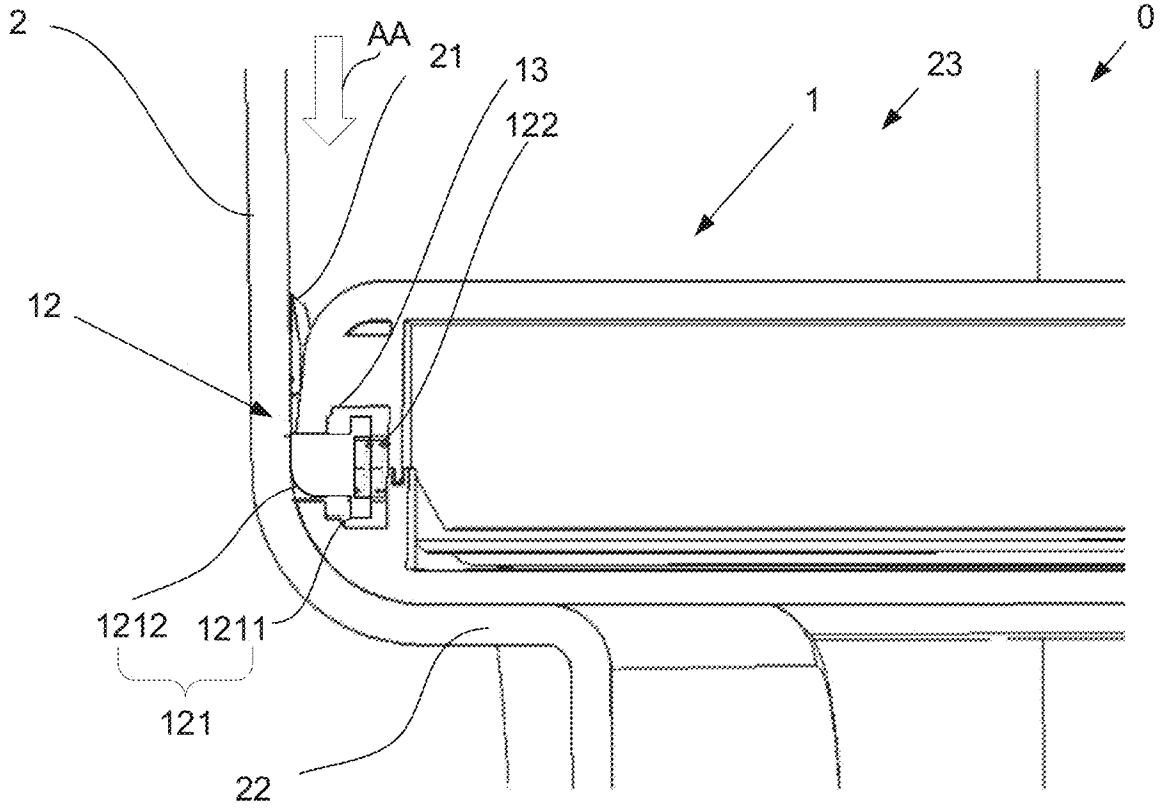
FIG. 3 is a sectional view of a the bathtub of FIG. 2 and the bath plate of FIG. 1, according to some embodiments.

As shown in FIGS. 2-3, when the bath plate 1 is put into and installed within the bathtub body 2, and when the bathtub is empty (e.g., the bathing volume 23 is not filled with water and/or bathing fluids), the telescopic piece 12 is retracted by the pressure of a bathtub wall protrusion 21, and the telescopic piece 12 is smoothly clamped under the bathtub wall protrusion 21 from top to bottom. When the bathtub is filled (e.g., the bathing volume 23 is filled with water and/or bathing fluids to a depth that corresponds to at least the bathtub wall protrusions 21), the telescopic piece 12 extends outwards to compensate for deformation due to various loads applied to the bathing system 0 (e.g., to the walls of the bathtub body 2 due to fluid pressure, the bath plate body 11 due to fluid pressure and/or a user applying weight to the bath plate body 11, etc.), and the telescopic piece 12 engages the bathtub body 2 and the bathtub wall protrusion 21 (e.g., maintains contact with the wall of the bathtub body 2 below the bathtub wall protrusion 21), so as to prevent the bath plate 1 from becoming loose within the bathing volume 23 or floating within the bathing volume 23.

In some embodiments, by arranging the telescopic pieces 12 on the two sides (e.g., opposite sides of the bath plate 1 that abut or approximately abut against the opposing walls of the bathtub body 2 on which the bathtub wall protrusions 21 are located) of the bath plate 1, and through the engagement between the telescopic pieces 12 and the bathtub wall protrusions 21 of the bathtub body 2, the bath plate 1 is clamped tightly to the bathtub body 2, and a floating problem of the bath plate 1 is prevented.

As shown in FIGS. 1 and 3, bath plate 1 includes a bath plate body 11 and telescopic pieces 12 arranged on two sides of the bath plate body 11. The telescopic pieces 12 are fixedly connected with the bath plate body 11. The two sides of the bath plate body 11 are provided with cavities 13, the cavity 13 is provided with an opening towards an outside of the bath plate body 11, and the telescopic piece 12 is partially accommodated in the cavity 13 and protrudes from the opening. The bath plate body 11 may have a substantially rigid portion between the sides of the bath plate body 11 having the telescopic pieces 12 such that the bath plate body 11 can span a gap defined between the opposing walls of the bathtub body 2, and resist deforming when subjected a load applied to the bath plate body 11 (e.g., a weight of a user applied to the bath plate body 11, a weight of a user sitting on the bath plate body 11, etc.).

In some embodiments, the telescopic piece 12 includes a bath plate stopper 121 (e.g., a catch, a detent, etc.) and a biasing member (e.g., a spring, a magnet, an elastic member, etc.) shown as resetting piece 122. In some embodiments, the resetting piece 122 is accommodated inside the cavity 13, the bath plate stopper 121 is partially accommodated inside the cavity 13, and the bath plate stopper 121 partially protrudes from the opening of the cavity 13. In some embodiments, the resetting piece 122 is connected with the bath plate stopper 121 and exerts a pre-tensioning force (e.g., a biasing force) towards the opening on the bath plate stopper 121. In some embodiments, the bath plate stopper 121 includes a stopper head 1211 connected with the resetting piece 122 and a stopper body 1212 partially protruding from the opening. In some embodiments, a diameter of the stopper head 1211 is larger than an opening diameter of the cavity 13, and a diameter of the stopper body 1212 is smaller than the opening diameter of the cavity 13. In some embodiments, the stopper body 1212 is slidable within cavity 13 between an extended position (e.g., a fully protruding position) and a retracted position where the stopper body 1212 is entirely within the cavity 13 and does not protrude from the opening of the cavity 13.

In some embodiments, the bath plate stopper 121 is a polymer (e.g., plastic) stopper.

In some embodiments, the resetting piece 122 is a spring (e.g., a compression spring), one end of the spring abuts against a cavity wall of the cavity 13, and the other end of the spring abuts against the bath plate stopper 121.

As shown in FIGS. 1 and 3, the two sides of the bath plate body 11 (e.g., the sides of the bath plate 1 corresponding to the left-hand side of FIG. 1 and the right-hand side of FIG. 1) are provided with the cavities 13. In some embodiments, the resetting piece 122 is a spring. In some embodiments, the resetting piece 122 is accommodated in the cavity 13 and is configured to exert a pre-tensioning force towards the opening of the cavity 13 to bias the bath plate stopper 121 toward the opening of the cavity 13 (e.g., toward the extended position). In some embodiments, the bath plate stopper 121 is made of polyformaldehyde (POM).

As shown in FIG. 2, when the bathtub system 0 is empty (e.g., the bathing volume 23 is not filled with water and/or bathing fluids), the bath plate 1 may be placed in and installed in the bathtub body 2 by translating the bath plate 1 within the bathing volume 23 such that the bath plate stoppers 121 pass over the bathtub wall protrusions 21. For example, the bath plate 1 can be installed by translating the bath plate 1 in the direction AA in FIGS. 2-3 such that the bath plate stopper 121 passes over the bathtub wall protrusion 21. In some embodiments, the bath plate 1 makes an audible snapping sound upon being installed in the bathtub body 2 (e.g., the bath plate 1 may snap into place). During the installation process, the bath plate stopper 121 compresses the resetting piece 122 and slides over the bathtub wall protrusion 21. After sliding over the bathtub wall protrusion 21, the pre-tensioning force exerted by the resetting piece 122 pushes the bath plate stopper 121 to press the wall of the bathtub body 2. When the bathing volume 23 is filled with water, a wall of the bathtub may deform, and the pre-tensioning force exerted by the resetting piece 122 pushes the bath plate stopper 121 against the wall to compensate for the deformation of the side wall of the bathtub (e.g., the resetting piece 122 may force the bath plate stopper 121 to maintain contact with the bathtub body 2), and the bath plate stopper 121 is clamped by the bathtub wall protrusion 21, and prevents the bath plate 1 from floating.

In some embodiments, the bath plate 1 may be taken out of the bathtub body 2 (e.g., removed from the bathing volume 23). Since the diameter of the stopper head 1211 is larger than the opening diameter of the cavity 13, the bath plate stopper 121 can be prevented from coming out of the cavity 13 when the bath plate 1 is uninstalled (e.g., the bath plate stopper 121 no longer is forced against the of the bathtub body 2 and is instead constrained from exiting the cavity 13 by the cavity 13).

In some embodiments, the cavity 13 is arranged to accommodate (e.g., house, receive, etc.) the telescopic piece 12, and the resetting piece 122 exerts the pre-tensioning force (e.g., biasing force), which influences the telescopic piece 12 to pass over and be retained by the bathtub wall protrusion 21, thus preventing the bath plate 1 from floating. In some embodiments, the bath plate stopper 121 includes a retaining portion having a larger diameter than the opening of the cavity 13, which retains at least a portion of the bath plate stopper 121 within the cavity 13 when the bath plate 1 is not installed in the bathing volume 23.

As shown in FIGS. 1-5, bathtub system 0 includes the bath plate 1 and a bathtub body 2. The bath plate 1 is removably coupled (e.g., detachably connected) with the bathtub body 2. In some embodiments, the bathtub body 2 is provided with a bathtub wall protrusion 21 configured to engage the telescopic piece 12.

Figure 5:
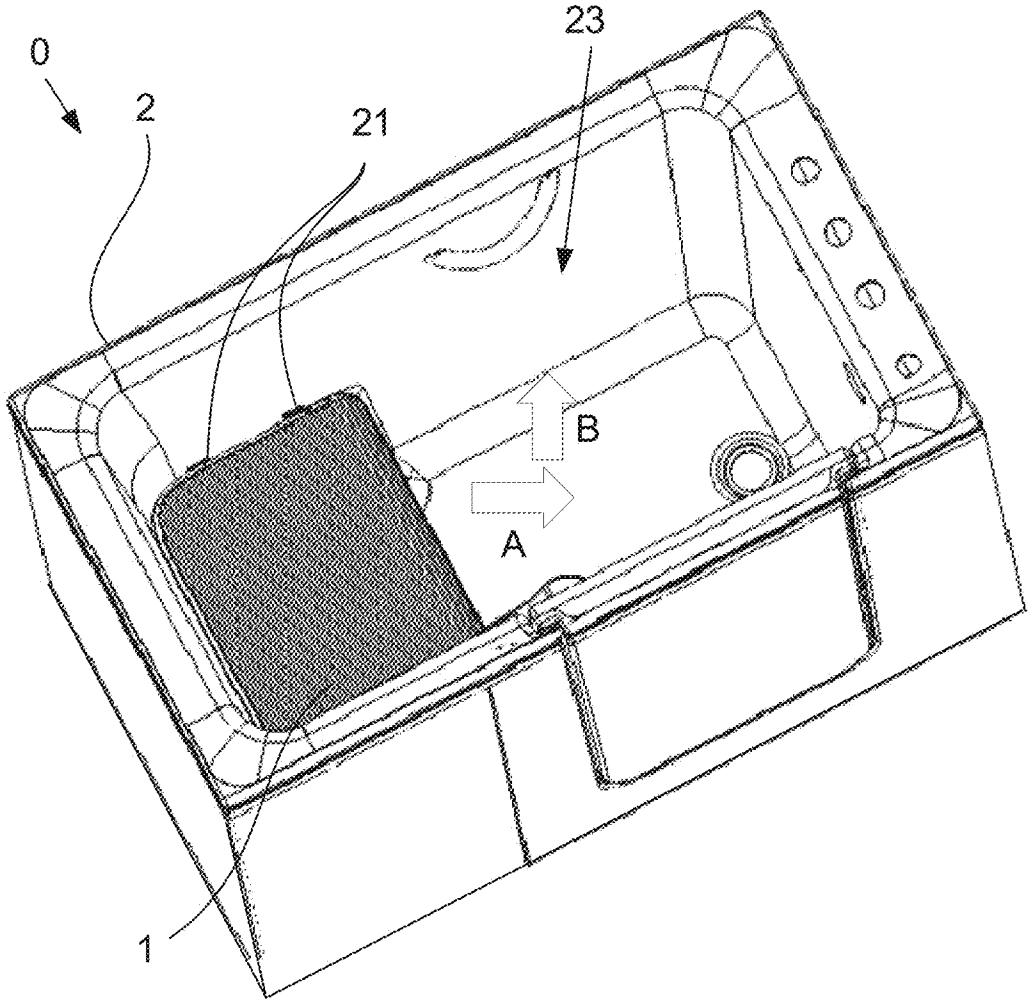
FIG. 5 is a schematic diagram of the bathtub of FIG. 2 and the bath plate of FIG. 1, according to some embodiments.

As shown in FIGS. 2, 3, and 5, the bath plate 1 is detachably connected with the bathtub body 2. As shown in FIG. 2, a user may install the bath plate 1 in the bathing volume 23 of defined by the bathtub body 2 by translating the bath plate 1 in the direction A. When the bathtub is empty, the telescopic piece 12 is retracted by the pressure of the bathtub wall protrusion 21, and the telescopic piece 12 is smoothly clamped under the bathtub wall protrusion 21 from top to bottom. When the water is full, the telescopic piece 12 extends outwards to compensate for the deformation of a side wall of the bathtub, and the telescopic piece 12 is clamped to the bathtub wall protrusion 21, so as to prevent the bath plate 1 from floating.

As shown in FIG. 5, the user may also take out the bath plate 1 from the bathtub body 2. The user only needs to stretch the bath plate 1 forward and take out the bath plate 1 when the telescopic piece 12 avoids a position of the bathtub wall protrusion 21.

In some embodiments, by arranging the telescopic pieces 12 on the two sides of the bath plate 1, and through the matching between the telescopic pieces 12 and the bathtub wall protrusions 21 of the bathtub body 2, the bath plate 1 is clamped tightly, and a floating problem of the bath plate 1 is solved.

As shown in FIG. 1 to FIG. 5, the bathtub system 0 includes the bath plate 1 and a bathtub body 2 detachably connected with the bath plate 1, wherein a bathtub wall of the bathtub body 2 is provided with a bathtub wall protrusion 21 matched with the telescopic piece 12, a bottom portion of the bathtub body 2 is provided with a step 22, and the bath plate 1 can be placed on the step 22.

In some embodiments, a distance between the bathtub wall protrusion 21 and the step 22 is a first distance, when the bath plate 1 is placed on the step 22, a distance between the telescopic piece 12 and the step 22 is a second distance, and the first distance is larger than the second distance.

In some embodiments, the bathtub wall protrusion 21 is a spacer.

In some embodiments, the bathtub body 2 is a walk-in bathtub body.

As shown in FIGS. 2 and 3, a user installs the bath plate 1 (e.g., moves the bath plate 1 downward in a direction AA), and the telescopic pieces 12 passes over the bathtub wall protrusion 21, and the bath plate stopper 121 is restricted to travel upward by the bathtub wall protrusion 21. In some embodiments, the bathtub body 2 includes a step 22 (e.g., a protrusion, a ledge, a bath plate support feature, etc.), shown as step 22, below the bathtub wall protrusion 21, and the bath plate 1 is installed above is supported by the step 22.

In some embodiments, a quantity of the bathtub wall protrusion 21 is the same as a quantity of the telescopic piece 12, that is, each bathtub wall protrusion 21 corresponds to one telescopic piece. In some embodiments, four Polymethyl Methacrylate (PMMA) spacers are attached as the bathtub wall protrusions 21 on the bathtub walls at the two sides, and two bathtub wall protrusions 21 are attached on the bathtub wall at each side. In some embodiments, four polyformaldehyde (POM) plastic stoppers, which are used as the bath plate stoppers 121, are fixed on the two sides of the bath plate body 11 by springs. In some embodiments, two bath plate stoppers 121 are fixed at each side. In some embodiments, a distance between the bathtub wall protrusions 21 on the same side is the same as a distance between the bath plate stoppers 121 on the same side.

In some embodiments, during installation, each bath plate stopper 121 of the bath plate 1 slides over the corresponding bathtub wall protrusion 21 through a pressure spring, and the bath plate 1 is put into the bathtub body 2 and supported by the step 22.

In some embodiments, after the bath plate stopper 121 passes through the bathtub wall protrusion 21, a spring force can make the bath plate stopper 121 reset and snap under the bathtub wall protrusion 21, thus preventing the bath plate 1 from floating.

In some embodiments, a distance between the bathtub wall protrusion 21 and the step 22 is a first distance, and when the bath plate 1 is placed on the step 22, a distance between the telescopic piece 12, preferably the bath plate stopper 121 and the step 22 is a second distance, and the first distance is larger than the second distance, so that the bath plate stopper 121 is located below the bathtub wall protrusion 21 when the bath plate 1 is placed on the step 22, and the upward travel of the bath plate 1 is limited by the bathtub wall protrusion 21, thus preventing the bath plate 1 from becoming loose within the bathing volume 23 and/or floating within the bathing volume 23.

Figure 4:
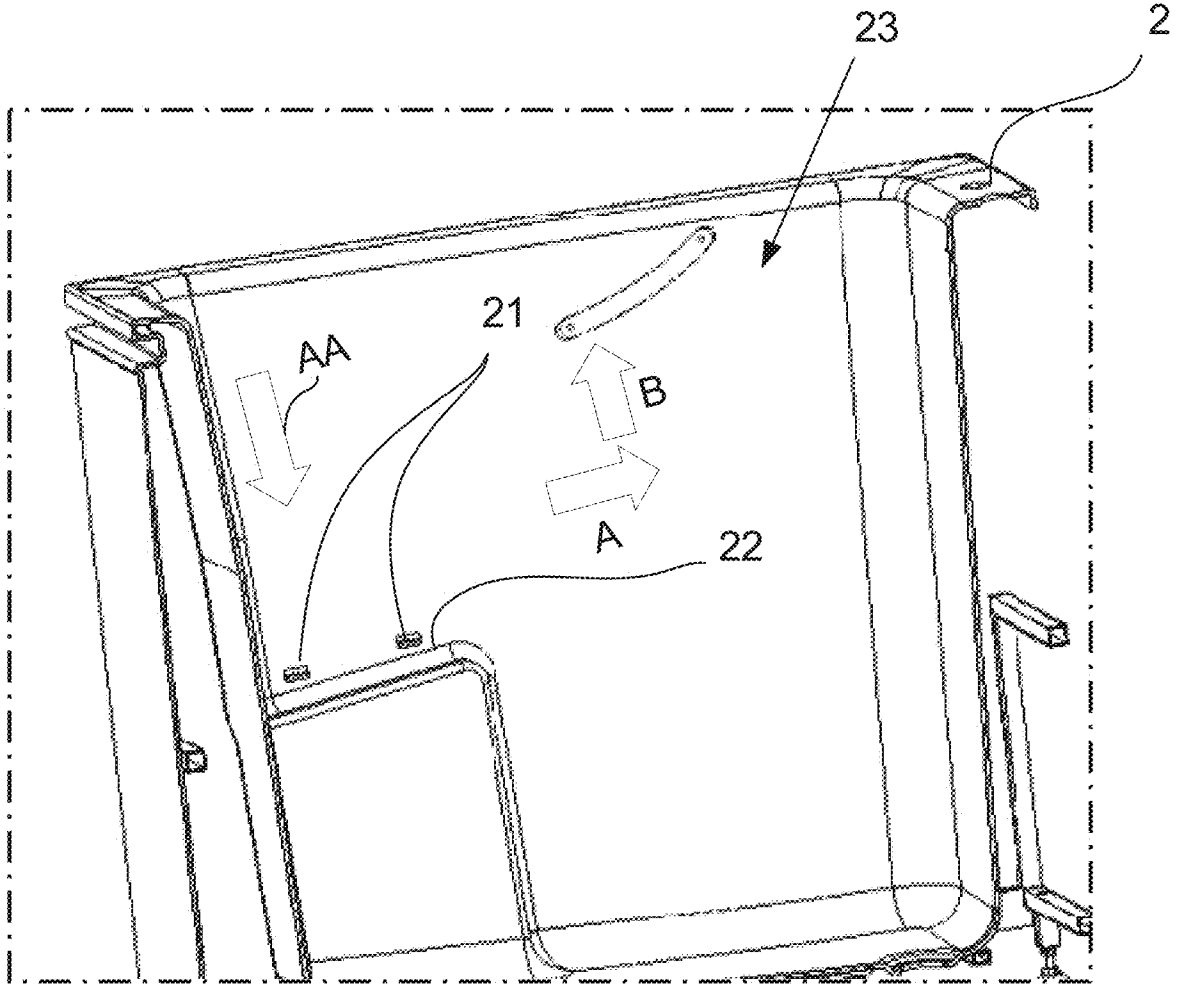
FIG. 4 is a sectional view of the bathtub of FIG. 2, according to some embodiments.

As shown in FIGS. 4-5, to uninstall the bath plate 1, the bath plate 1 is translated in a direction of an arrow A. In some embodiments, when the bath plate stopper 121 gets out of the position of the bathtub wall protrusion 21, (for example, travels approximately 20 mm), and the user can turn up the bath plate 1 in a direction of an arrow B and separate the bath plate 1 from the bathtub body 2.

In some embodiments, the step 22 is arranged to place the bath plate 1 to provide support for the bath plate 1.

The above embodiments merely express several embodiments of the application, and the descriptions thereof are more specific and detailed, but cannot be understood as a limitation to the patent scope of the application. It should be noted that those of ordinary skills in the art may make a plurality of decorations and improvements without departing from the conception of the application, and these decorations and improvements shall all fall within the protection scope of the application. Therefore, the protection scope of the patent according to the present application shall be subjected to the claims appended.

As utilized herein with respect to numerical ranges, the terms "approximately," "about," "substantially," and similar terms generally mean +/−10% of the disclosed values, unless specified otherwise. As utilized herein with respect to structural features (e.g., to describe shape, size, orientation, direction, relative position, etc.), the terms "approximately," "about," "substantially," and similar terms are meant to cover minor variations in structure that may result from, for example, the manufacturing or assembly process and are intended to have a broad meaning in harmony with the common and accepted usage by those of ordinary skill in the art to which the subject matter of this disclosure pertains. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various embodiments, are intended to indicate that such embodiments are possible examples, representations, or illustrations of possible embodiments (and such terms are not intended to connote that such embodiments are necessarily extraordinary or superlative examples).

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic.

References herein to the positions of elements (e.g., "top," "bottom," "above," "below") are merely used to describe the orientation of various elements in the FIGURES. It should be noted that the orientation of various elements may differ according to other exemplary embodiments, and that such variations are intended to be encompassed by the present disclosure.

Although the figures and description may illustrate a specific order of method steps, the order of such steps may differ from what is depicted and described, unless specified differently above. Also, two or more steps may be performed concurrently or with partial concurrence, unless specified differently above. It is important to note that any element disclosed in one embodiment may be incorporated or utilized with any other embodiment disclosed herein.

DESCRIPTIONS OF REFERENCE NUMERALS

1—bath plate; 11—bath plate body; 12—telescopic piece; 121—bath plate stopper; 1211—stopper head; 1212—stopper body; 122—resetting piece; 13—cavity; 2—bathtub body; 21—bathtub wall protrusion; 22—step.

What is claimed is:

1. A bath plate for a bathtub, comprising:

a bath plate body having a plurality of sides, wherein at least two of the plurality of sides each define a cavity, each cavity defining an opening; and a plurality of telescopic pieces each housed at least partially within a corresponding cavity of the bath plate body, the telescopic pieces each comprising:

a bath plate stopper;

a stopper head positioned on an end of the bath plate stopper; and a biasing member configured to bias the bath plate stopper towards the opening of the cavity;

wherein the stopper head and the biasing member are fully enclosed within the cavity of the bath plate body, such that the telescopic pieces are fixedly connected with the bath plate body.

2. The bath plate of claim 1, wherein the stopper head is connected with the biasing member.

3. The bath plate of claim 1, wherein the bath plate stopper is a plastic stopper.

4. The bath plate of claim 1, wherein the biasing member is a spring, wherein one end of the spring abuts against a wall of the cavity, and a second end of the spring abuts against the bath plate stopper.

5. The bath plate of claim 1, wherein a diameter of the stopper head is larger than an opening diameter of the cavity, and a diameter of the bath plate stopper is smaller than the opening diameter of the cavity.

6. A bathtub system, comprising:

a bathtub body comprising a bottom and a plurality of walls, the bathtub body defining a bathing volume; and a bath plate configured to detachably connect with the bathtub body within the bathing volume, the bath plate comprising:

a bath plate body; and a plurality of telescopic pieces arranged on two sides of the bath plate body and fixedly connected with the bath plate body;

wherein a first wall and a second wall of the plurality of walls of the bathtub body comprises a first wall protrusion that extends outward from the first wall and a second wall protrusion that extends outward from the second wall, such that the first wall protrusion and the second wall protrusion are substantially parallel to the bottom of the bathtub body, and wherein the first wall protrusion and the second wall protrusion are configured to retain the telescopic pieces and the bath plate body in an installed position, wherein the bath plate body is spaced apart from and substantially parallel to the bottom of the bathtub body in the installed position.

7. The bathtub system of claim 6, wherein a portion of the bathtub body is provided with a step protruding into the bathing volume, and the bath plate is configured to span a gap defined between the step, and the bath plate is supported by the step when the bath plate is in the installed position within the bathing volume.

8. The bathtub system of claim 7, wherein a distance between the first wall protrusion and the step is a first distance, wherein when the bath plate is in the installed position, a distance between the telescopic pieces and the step is a second distance, and wherein the first distance is larger than the second distance.

9. The bathtub system of claim 6, wherein at least one of the first wall protrusion or the second wall protrusion is a spacer.

10. A bathtub system, comprising:

a bathtub body having walls and a bottom defining a bathing volume, wherein a first wall comprises a first wall protrusion and a first step portion, and wherein a second wall comprises a second wall protrusion and a second step portion, wherein the first step portion and the second step portion are spaced within the bathing volume; and a bath plate configured to detachably connect with the bathtub body within the bathing volume, the bath plate comprising:

a bath plate body defining a first cavity on a first side and a second cavity on a second side; and a bath plate stopper configured to slide within the first cavity between a first position and a second position;

wherein the bath plate stopper is configured to slide between the first position and the second position to maintain contact with the first wall when the bath plate is in an installed position within the bathing volume, and wherein a distance between the first wall protrusion and the first step portion is a first distance, wherein when the bath plate is in the installed position a distance between the bath plate stopper and the first step portion is a second distance, and wherein the first distance is larger than the second distance.

11. The bathtub system of claim 10, wherein the bath plate stopper is configured to partially protrude from the bath plate body in the first position, and wherein the bath plate further comprises a biasing member configured to bias the bath plate stopper toward the first position.

12. The bathtub system of claim 10, wherein the first cavity defines a cavity opening, and wherein a first portion of the bath plate stopper is configured to be retained within the first cavity by the cavity opening.

13. The bathtub system of claim 12, wherein the first portion has a first diameter, and wherein the first diameter is larger than a diameter of the cavity opening.

14. The bathtub system of claim 10, wherein the bath plate is supported by the first step portion and the second step portion within the bathing volume when the bath plate is in the installed position.

15. The bathtub system of claim 10, wherein the bath plate comprises a spring configured to bias the bath plate stopper to partially protrude from the first cavity.

16. The bathtub system of claim 15, wherein the spring is coupled to the bath plate stopper within the first cavity.

17. The bathtub system of claim 15, wherein the bath plate comprises a second bath plate stopper configured to slide within the second cavity between a third position and a fourth position.

18. The bathtub system of claim 17, wherein the bath plate stopper is biased toward the first position by a first biasing member, and the second bath plate stopper is biased toward the third position by a second biasing member, wherein the second bath plate stopper is configured to slide between the third position and the fourth position to maintain contact with the second wall when the bath plate is in the installed position within the bathing volume.

* * * * *